United States Patent [19]

Hyoty et al.

[11] Patent Number: 5,062,921

[45] Date of Patent: Nov. 5, 1991

[54] METHOD FOR REGULATING THE FEED OR COMBUSTION CONDITIONS OF CONCENTRATED WASTE LIQUORS IN A SODA RECOVERY UNIT

[75] Inventors: Paavo Hyoty; Erik Saiha, both of Tampere, Finland

[73] Assignee: Oy Tampella Ab, Tampere, Finland

[21] Appl. No.: 500,951

[22] Filed: Mar. 29, 1990

[30] Foreign Application Priority Data

Mar. 31, 1989 [FI] Finland ..... 891574

[51] Int. Cl.[5] ..... D21C 11/12

[52] U.S. Cl. ..... 162/31; 162/49; 110/185; 110/186; 110/238

[58] Field of Search ..... 162/31, 49, DIG. 10; 110/238, 185, 186; 431/7

[56] References Cited

U.S. PATENT DOCUMENTS 4,891,097 1/1990 Hyoty et al. ..... 162/31

*Primary Examiner*—Peter Chin

*Attorney, Agent, or Firm*—Cushman, Darby & Cushman

[57] ABSTRACT

A method for regulating the feed and/or combustion conditions of concentrated waste liquors of varying chemnical and physical properties, for their burning in a soda recovery unit, by determining the maximum expansion upon heating of a dry matter particle of the liquor to be fed into the soda recovery unit, and by regulating the feed and/or combustion conditions on the basis of the expansion thus determined. The measure used for the expansion is the ratio of the lignin present in the concentrated liquor to any one or several of the acids present in the concentrated liquor, such as aliphatic acids.

7 Claims, 1 Drawing Sheet

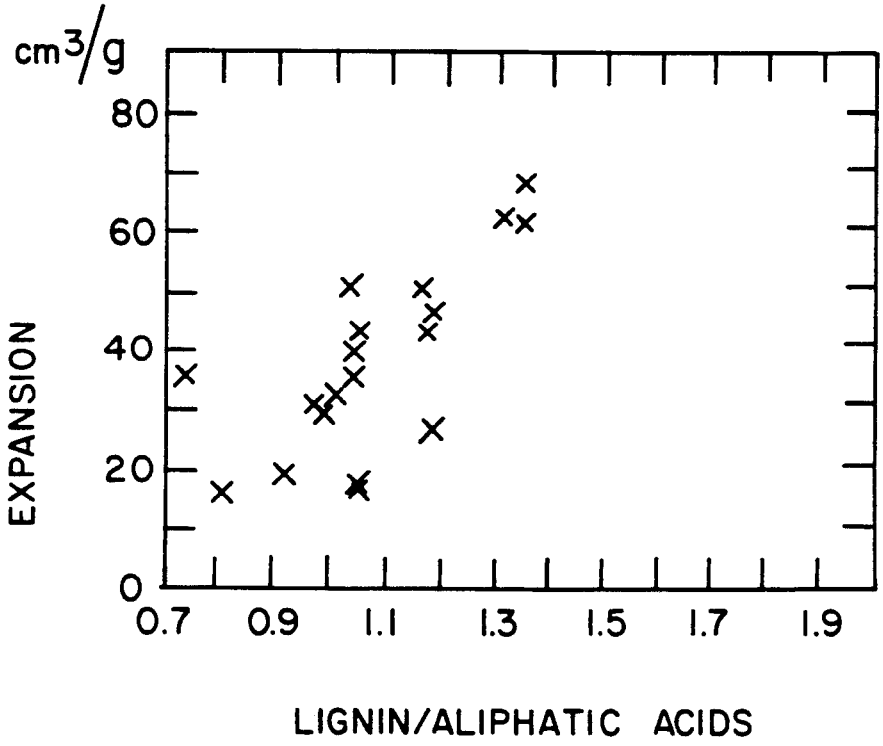
cm3/g
80
60
40
20
0
EXPANSION
0.7
0.9
1.1
1.3
1.5
1.7
1.9
LIGNIN/ALIPHATIC ACIDS

METHOD FOR REGULATING THE FEED OR COMBUSTION CONDITIONS OF CONCENTRATED WASTE LIQUORS IN A SODA RECOVERY UNIT

A method for regulating the feed or combustion conditions of concentrated waste liquors of varying chemical and physical properties, for their burning in a soda recovery unit

BACKGROUND OF THE INVENTION

The present invention relates to a method for regulating the feed and/or combustion conditions of concentrated waste liquors of varying chemical and physical properties, for their burning in a soda recovery unit, by determining the maximum expansion upon heating of a dry-matter particle of the liquor to be fed into the soda recovery unit, and by regulating the feed and/or combustion conditions on the basis of the expansion thus determined.

It is known that waste liquor is produced in pulping and that in terms of the pulp production economy it is very important that the heat content and chemicals of this waste liquor are recovered as thoroughly as possible for utilization in the pulp production process. Before the waste liquor is burned in order to release thermal energy and to recover chemicals, water is evaporated from the waste liquor so that a concentrated liquor having a water content of approx. 28–40% is obtained, which is then burned in a soda recovery unit, the thermal energy thereby released being usable in the pulp production process and the chemicals being recoverable from the bottom of the soda recovery unit and capable of being used, after regeneration, for the preparation of cooking liquor.

As the price of energy has continually increased, it has become more and more important in terms of the pulping process economy to make the burning of liquor in a soda recovery unit as disturbance-free as possible in order to achieve a good chemicals economy, low emissions, and a high energy efficiency and economy. For the primary function of the soda recovery unit, i.e. the recovery and regeneration of salts for the preparation of cooking liquor, it is necessary to create in the lower section of the soda recovery unit a reducing zone having a high temperature, with a so-called pile in its lower section. The degree of regeneration in the unit is measured in terms of sulfur reduction.

The recovery of salts is measured on the basis of chemical losses. Losses are incurred when gases for example $SO_2$, are removed together with the flue gases.

It is also a function of the soda recovery unit to recover heat from the flue gases. The efficiency of this can be measured by the extent of the flue gas loss, as the share of unburned gases, and by the availability of the recovery unit, for example stoppages due to the soiling of the fire surfaces.

The functioning of the soda recovery unit is affected by many factors. The concentrated liquor fed into the recovery unit still contains a relatively large amount of water (approx. 28–40%). This water amount must be caused to evaporate in the soda recovery unit, and the evaporation must take place substantially from a liquor drop falling towards the pile on the bottom of the soda recovery unit, before the drop reaches the surface of the pile. If this does not occur, a large proportion of the water must be evaporated from the surface of the pile, which, of course, decreases the temperature of the pile, which for its part increases the emission of sulfur dioxide and decreases reduction.

It is known that the drop diameter in soda recovery units varies at a ratio of approx. 1:3. Some of the drops have at that time dried, and the pyrolysis has started in the gas atmosphere. Some of the drops fall into the pile while wet. The average drop size determines the flow of dry matter onto the pile. If the liquor expansion properties change, the above-mentioned flow of dry matter to the pile changes.

If the water has evaporated before the drops reach the pile, the drops become, owing to expansion, so light that they may be captured by the rising gas flow in the soda recovery unit, in which case they are pyrolysed and burned in the gas flow, the dust load of which increases. Efforts are made to make the size of the liquor drops in the soda recovery unit such that the dry matter content will be suitable at the time a drop hits the pile surface, and the remaining small amount of water will rapidly leave the pile surface and produce a porous pile. Thus the pile on the bottom of the furnace is caused to become hot, which makes possible a good chemicals economy and a good availability.

A drop size suitable for the functioning of the soda recovery unit has been determined visually on the basis of experience, for example, by observing the temperature of the pile on the bottom of the soda recovery unit on the basis of color or by measuring. It has been noted that it is the viscosity of the liquor fed into the soda recovery unit that primarily determines the size of a drop formed in the gas chamber of the soda recovery unit, when, for example, the size and type of the nozzles feeding liquor into the recovery unit and the feed pressure remain substantially constant. Respectively, when the viscosity remains constant, the drop size is determined under the effect of the nozzle diameter at a constant flow rate of the liquor.

In order to maintain the drop size in the above-mentioned manner at a value which has experimentally been found to be good, the dry matter content of the concentrated liquor, determined either on the basis of density or by means of a refractometer, has been used as the control quantity, and on the basis of the measuring result, efforts have been made to determine the changes which are to be effected in the temperature and the injection pressure of the liquor to be fed into the soda recovery unit, in order to produce drops of the desired size in the gas chamber of the soda recovery unit. Efforts have been made in this case in the main to regulate the viscosity of the liquor by heating it. Such regulation is described in the publication Pulp and Paper 53, (1979) 9, pages 142–145.

Areometric measurement is commonly used for measuring density. Dry matter measurement by means of a refractometer for its part yields, when the raw material and the digestion remain constant, a quantity which can be utilized in the control of the soda recovery unit.

Disturbance-free operation of the soda recovery unit has previously been implemented by maintaining the production process and, consequently, the properties of the concentrated liquor, as constant as possible, and therefore it has been possible to run the combustion process at a constant setting. Pulp mills previously used one single type of wood, determined mill by mill, and likewise, usually one single pulp type was produced, the result being that the chemical composition of the waste liquor remained more or less unchanged.

The operation of the evaporation plant was regulated so that a certain, maximally constant dry matter content was accomplished, according to which the combustion process was regulated. Efforts were made to regulate the dry matter content with an accuracy of approx. ±1.5 percentage units. If fluctuations are great, they are reflected in the operation of the soda recovery unit, causing changes in the degree of reduction, emissions of $SO_2$ gas, and soiling of the unit. When problems have appeared, the operator of the recovery unit has requested checking whether process values at the evaporation plant and the digestion have remained within the set range.

Fluctuations in the chemical composition of the concentrated liquor to be burned are caused by processes which are becoming increasingly closed, i.e. closed chemicals cycles. Variations in the raw material also require new digestion values, complicating the operation of the evaporation plant. Likewise, liquors from more and more different digestion processes are burned in the same recovery unit. In these conditions the properties of the liquor cannot be maintained as constant as previously.

When mixtures of parallel digestion liquors are used and when other wastes are added to the concentrated waste liquor, the disturbance is shifted directly to the soda recovery unit.

In addition to the above major disturbances brought to the soda recovery unit, the overall requirement level imposed upon equipment has risen. The requirement of usability under varying conditions is high, while the $SO_2$ level in the flue gases and the degree of reduction in the melt must be at a controlled level.

The feeding in of concentrated liquors of varying chemical and physical properties into the soda recovery unit in order to produce a suitable drop size in the unit has been regulated by changing the feed conditions of the liquor fed into the soda recovery unit, not only on the basis of the dry matter content measured from the concentrated liquor, mentioned above, but alternatively on the basis of the viscosity value measured directly from the liquor fed into the soda recovery unit, as disclosed in Finnish Patent 64 409. The use of viscosity measurement as the control quantity for liquor feed is much more rapid and simpler than controlling the soda recovery unit on the basis of a dry matter analysis. On the basis of viscosity measurements it is possible to adjust the feed conditions rapidly to such a level that the liquor discharging from the nozzles forms drops of the desired size.

From Finnish Patent 70 270 there is known a method of the type described in the beginning of the present description to control the feed and/or combustion conditions of concentrated liquors of varying chemical and physical properties, for their burning in a soda recovery unit, by measuring the maximum expansion upon heating of a dry matter particle in the liquor fed into the soda recovery unit and by adjusting the feed and/or combustion conditions directly on the basis of the maximum expansion thus measured.

According to this Finnish Patent 70 270, the maximum expansion of the liquor is measured by photographing the expansion of a drop in a laboratory furnace and by measuring from the photographs the ratios of drop diameters or by measuring the combustion of drops of a certain size in a constant-temperature furnace, in which case the combustion period is proportional to the maximum expansion. These measuring methods are, however, relatively difficult to carry out and require of the performer of the measurement great precision and care, and owing to human factors the measurement results are not always reliable.

SUMMARY OF THE INVENTION

The object of the present invention is to provide a simple and reliable measuring method for determining the expansion which has a substantial effect on combustion in the soda recovery unit.

Thus, according to the present invention it has been observed that it is possible to use as a measure of the expansion the ratio of the lignin present in the concentrated liquor to any one or several of the acids, for example aliphatic acids, present in the concentrated liquor, and in particular the ratio to their sum. According to the invention it has surprisingly been observed that there is a mutual dependence relation between the expansion and the ratio of lignin to aliphatic acids. On the basis of this, the expansion can according to the invention be determined by measuring the concentration of lignin and the concentration of aliphatic acids in the concentrated waste liquor.

On the basis of the result of these last-mentioned measurements it is possible to regulate the feed conditions by regulating either the chemical or the physical properties of the concentrated waste liquor. The physical properties of the liquor, on the other hand, can be regulated by heating or cooling the liquor in order to change its viscosity. The feed conditions can also be regulated by changing the feed pressure of the liquor fed into to the soda recovery unit, the size of the feeding nozzles and/or their height from the bottom of the soda recovery unit, which affects the time it takes for a liquor drop to fall within the furnace.

Alternatively, or in addition to this, the combustion conditions in the soda recovery unit can be regulated on the basis of the measuring result by regulating the distribution of the primary and the secondary air fed into the soda recovery unit.

BRIEF DESCRIPTION OF THE DRAWING

The invention is described below in greater detail with reference to the accompanying Figure, which depicts the specific expansion of concentrated liquor as a function of the ratio of lignin to aliphatic acids.

DETAILED DESCRIPTION

The Figure depicts measurement results obtained in laboratory experiments, which are described in greater detail below. Chips (screened fraction 2–4 mm) prepared from pine wood (Pinus sylvestris) were digested in an autoclave. Sulfate, anthraquinone(AQ) and soda-anthraquinone digestions were carried out under the following digestion conditions:

| | |
|---|---|
| effective alkali | 22% (as NaOH) of weight of wood |
| sulfide content | 30% |
| AQ addition | 0.2% of weight of wood |
| liquid/wood ratio | 4 l/kg |
| heating period | 90 min |
| maximum temperature | 175 °C. |

The yields were: 63.4% (sulfate), 64.2% (anthraquinone), and 66.0% (soda-anthraquinone).

The liquor samples were analyzed to determine the lignin concentration and the concentration of acids. Hydroxymonocarboxylic acids and hydroxydicarboxylic acids were analyzed as their trimethylsilyl derivatives gas chromatographically, as described in the publication Alén, R., Niemelä, K., Sjöström, E., J. Chromatogr. 301 (1984), pp. 273–276. Formic acid and acetic acid were determined as their benzyl esters gas chromatographically, as described in the publication Alén, R., Jännäri, P., Sjöström, E., Finn. Chem. Lett. (1985), p. 190–192.

The concentration of lignin was calculated from the chlorine number (SCAN-C 29:72), which was multiplied by the coefficient 0.899 (Kyrklund, B., Strandell, G., Paperi ja Puu 51 (1969), p. 299–305).

The expansion was determined mainly by the method developed by Hupa et al. (Hupa, M., Solin, P., Hyöty, P., Journal of Pulp and Paper Science, Vol. 13, No 2, 1987). The liquor samples were evaporated to a dry matter content of 60%. 10–12 drops of each liquor were burned at a temperature of 800 ° C., and the combustion was photographed using a video camera. The maximum expansion was measured from the video film. The mean diameter of an expanded drop was calculated using the formula $d=\sqrt{b.c}$, where b is the length of the drop and c is the width of the drop. By using this diameter, the specific expansion was calculated in $cm^3$ per one gram of the original dry matter.

Nineteen different liquors were investigated, and the results are presented in the accompanying Figure.

As is shown in the Figure, there is a clear correlation between the expansion and the ratio of lignin to aliphatic acids.

We claim:

1. A method for recovering heat and salts for preparation of cooking liquor from a feedstock of waste liquor produced in pulping of wood chips, including concentrating the feedstock of waste liquor to 28–40 percent water, spraying the concentrated waste liquor through a nozzle at the top of a soda recovery unit which has a porous pile containing pyrolysed liquor in a lower high temperature reducing zone thereof, and burning the sprayed droplets of concentrated waste liquor as they fall through the soda recovery unit from the nozzle to an upper surface of the pile whereby the droplets lose water to a flue gas stream which is taken off from the soda recovery unit and puff up into particles having a diameter larger than the diameter of the droplets emanating from the nozzle, the improvement comprising:

(a) measuring the ratio of lignin to at least one carboxylic acid present in said concentrated waste liquor while measuring the ratio of droplet diameter to particle diameter;

(b) correlating said ratio of lignin to carboxylic acid with said ratio of droplet diameter to particle diameter;

(c) monitoring the ratio of lignin to at least one carboxylic acid present in said concentrated waste liquor and using the correlation obtained in step (b) to indirectly monitor said ratio of droplet diameter to particle diameter; and (d) regulating a processing condition including at least one of a feed condition of the waste liquor and a combustion condition in the soda recovery unit in response to said monitored ratio of lignin to at least one carboxylic acid present in said concentrated waste liquor.

2. The method of claim 1, wherein:

said processing condition which is changed in step (d) is the temperature of the concentrated waste liquor being sprayed from the nozzle.

3. The method of claim 1, wherein:

said processing condition which is changed in step (d) is the pH of the concentrated waste liquor being sprayed from the nozzle.

4. The method of claim 1, wherein:

said processing condition which is changed in step (d) is the pressure of the concentrated waste liquor being sprayed from the nozzle.

5. The method of claim 1, wherein:

said processing condition which is changed in step (d) is the height of the nozzle from the pile.

6. The method of claim 1, wherein:

said processing condition which is changed in step (d) is the amount of air introduced into the soda recovery unit for drying and supporting combustion of the concentrated waste liquor being sprayed from the nozzle.

7. The method of claim 1, wherein:

said carboxylic acid selected from the group consisting of hydroxymonocarboxylic and hydroxydicarboxylic acids, and mixtures thereof, as trimethylsilyl derivatives thereof and, formic and acetic acids, and mixtures thereof as benzyl esters thereof.

* * * * *